US006468397B1

(12) United States Patent
Chuang

(10) Patent No.: US 6,468,397 B1
(45) Date of Patent: Oct. 22, 2002

(54) SCARFING SHOWER FOR FABRIC CLEANING IN A WET PAPERMAKING PROCESS

(75) Inventor: Strong C. Chuang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/467,620

(22) Filed: Dec. 20, 1999

(51) Int. Cl.[7] ..... D21F 1/32

(52) U.S. Cl. ..... 162/199; 162/272; 162/275; 162/279; 162/DIG. 7; 134/15; 134/18; 134/34; 134/48; 134/148; 134/199; 15/303; 15/320; 15/322

(58) Field of Search ..... 162/199, 190, 162/195, 263, 348, 194, 306, 272–279, 264, DIG. 7; 134/32–34, 42, 103.2, 98, 1, 148, 151, 157, 199, 159, 15, 21, 9, 48, 18; 15/302, 320, 322, 300.1

(56) References Cited

U.S. PATENT DOCUMENTS 2,255,951 A 9/1941 Tomtlund
3,830,691 A * 8/1974 Truesdale et al. ..... 162/273
3,910,815 A * 10/1975 Shelor ..... 162/199
4,474,644 A * 10/1984 Poulsen ..... 162/199
5,595,632 A * 1/1997 Macierewicz ..... 162/277
5,783,044 A 7/1998 Schneider et al.
5,820,732 A * 10/1998 Gregersen et al. ..... 162/275
5,851,358 A * 12/1998 Kade ..... 162/276
5,879,515 A * 3/1999 Straub et al. ..... 134/122 R
5,958,190 A 9/1999 Gregersen et al.
5,964,956 A * 10/1999 Straub et al. ..... 134/15
5,964,960 A * 10/1999 Boeck ..... 134/103.2
6,136,148 A * 10/2000 Koskinen et al. ..... 162/199
6,364,959 B1 * 4/2002 Straub et al. ..... 100/151

* cited by examiner

*Primary Examiner*—José A. Fortuna
(74) *Attorney, Agent, or Firm*—Dority & Manning, P.A.

(57) ABSTRACT

A system and process for removing unwanted fibers from a forming fabric during a wet papermaking process is disclosed. The system includes a scarfing shower configured to emit a cleaning fluid that contacts the forming fabric. In particular, the cleaning fluid tangentially contacts the forming fabric while the forming fabric is being guided around a turning roll. Preferably, the cleaning fluid is emitted in a direction that is opposite to the direction at which the forming fabric is moving.

35 Claims, 2 Drawing Sheets

SCARFING SHOWER FOR FABRIC CLEANING IN A WET PAPERMAKING PROCESS

FIELD OF THE INVENTION

The present invention is generally directed to a system and process for cleaning forming fabrics during a wet papermaking process. More particularly, the present invention is directed to a system and process for removing unwanted fibers from a forming fabric by contacting the fabric with a tangential fluid spray.

BACKGROUND OF THE INVENTION

In making various paper products, typically an aqueous suspension containing pulp fibers is first formed. The aqueous suspension is then spread out over a forming surface in order to form a paper web. The forming surface generally includes a series of endless conveyors which are formed from a porous fabric that can be made from metal, plastic, or any other suitable material. The forming fabrics are designed to facilitate formation of the nonwoven web, to transport the nonwoven web, and to remove excess liquid from the web as it travels downstream.

From the forming fabric, the nonwoven web is usually transported through a press section and then through one or more driers. Depending upon the paper product being formed, the nonwoven web can then be subjected to various post formation processes as desired.

One problem that is typically encountered during the formation of paper products is that the forming fabrics have a tendency to become fouled and clogged by bonding materials, additives contained within the fiber suspension, and especially, by paper fibers, which are referred to as "fiber carry back". Too much debris and fiber carry back on the forming fabric can create fiber waste and also can adversely affect sheet formation. The problems with fiber carry back become especially severe when the sheet being formed has a relatively low basis weight such as when making tissue paper, when short fibers at a low consistency are being used to form the paper sheet, at higher machines speeds, and when excessive amounts of fiber carry back begin to accumulate on the forming fabrics.

In the past, various attempts have been made in order to remove debris and contamination from the forming fabric. Systems used in the past, however, have generally not been very efficient at removing especially paper fibers. For example, although the typical high pressure water shower spraying onto the sheet side of the fabric can clean the majority of the fiber carry back, it also can push the fibers deeper into the interstices of the woven fabric causing accumulations that are much more difficult to remove.

As such, a need currently exists for a system and process that is capable of more effectively cleaning a forming fabric in a wet papermaking process. In particular, a need exists for a system and process for removing fibers, such as paper fibers, from a forming fabric that is used to transport a web prior to drying. A need further exists for a process and system for cleaning a forming fabric that does not substantially hinder or obstruct movement of the fabric.

SUMMARY OF THE INVENTION

Accordingly, it is object of the present invention to provide a process and system for cleaning debris, especially fibers, from a forming fabric in a wet papermaking process.

Another object of the present invention is to provide a system and process for cleaning a forming fabric in a papermaking process in which a stream of fluid tangentially contacts the sheet side of the forming fabric for removing the carry back fibers and other debris from the fabric.

Still another object of the present invention is to provide a process and system for cleaning a forming fabric that does not interfere or hinder the fabric during formation of a paper web.

These and other objects of the present invention are achieved by providing, in one embodiment, a system for removing unwanted fibers from a forming fabric during a wet papermaking process. The system includes a porous forming fabric that can be an endless conveyor made from, for instance, metal, plastic or any other suitable material. The forming fabric is positioned to receive a nonwoven web formed from an aqueous suspension of fibers. After the nonwoven web is transferred to the next process station, such as a press or a drying section, the forming fabric may be wrapped around one or more turning rolls as it is routed back to the forming section.

In accordance with the present invention, in order to remove fibers and other debris from the forming fabric, the system further includes a scarfing shower that is configured to emit a stream of fluid. In particular, the scarfing shower is positioned such that the stream of fluid tangentially contacts the forming fabric while the forming fabric is moving around the turning roll. Preferably the forming fabric is wrapped around the turning roll less than 90 degrees, and particularly less than 120 degrees, such as from about 2 degrees to about 120 degrees. For example, the scarfing shower can include one or more rows of nozzles that are spaced along the width of the forming fabric. Each nozzle can emit a cleaning fluid that slightly impinges and is mostly tangent to the fabric.

The fluid that is emitted by the scarfing fan shower preferably covers 100% of the fabric width to be cleaned. The shower can be, for instance, a liquid such as water. In one embodiment, the cleaning fluid can be a mixture of water and a surfactant, such as a soap. The liquid can be emitted from the scarfing shower at a pressure of at least 50 psi, and particularly at a pressure of at least 100 psi. In one embodiment, the cleaning fluid can be emitted from the scarfing shower at a pressure of from 100 psi to about 400 psi.

As stated above, the scarfing shower is positioned so as to contact the forming fabric with a fluid at a tangent to the fabric as the fabric is moving around the turning roll. Preferably, the direction of the cleaning fluid is opposite to the direction at which the forming fabric is moving. In this manner the relative velocity of the shower liquid to the fabric is enhanced and the cleaning power is also enhanced. In order to achieve this result, the scarfing shower can be positioned at any suitable location. For most applications, however, the scarfing shower contains a row of nozzles spaced from about 0.5 inches to about 3 inches apart, and particularly from about 1 inch to about 2 inches apart. Further, the nozzles can be positioned such that the issued liquid travels from about 2 inches to about 6 inches to hit the fabric, and particularly travels from about 3 inches to about 4 inches to hit the fabric.

In order to collect the cleaning fluid after it impinges upon the forming fabric, the system can also include a collecting pan that surrounds the area of the fabric that is cleaned. The collecting pan can include a drain for removing the liquid as it is collected.

These and other objects of the present invention are also achieved by providing a process for cleaning a forming fabric in a wet papermaking process. The process includes the steps of forming an aqueous suspension of fibers that are spread over a forming fabric in order to form a nonwoven web. The forming fabric can be, for instance, an endless belt that is wrapped around a turning roll at least 90 degrees. Once formed, the nonwoven web is removed from the forming fabric prior to the turning roll.

In accordance with the present invention, while the forming fabric is moving around the turning roll, the fabric is contacted with a stream of liquid at a location that is generally tangent to the fabric. The stream of liquid contacts the fabric in a direction that is generally opposite to the direction of the forming fabric, which removes fibers and other debris from the fabric as the fabric is moving through the system.

Other objects, features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
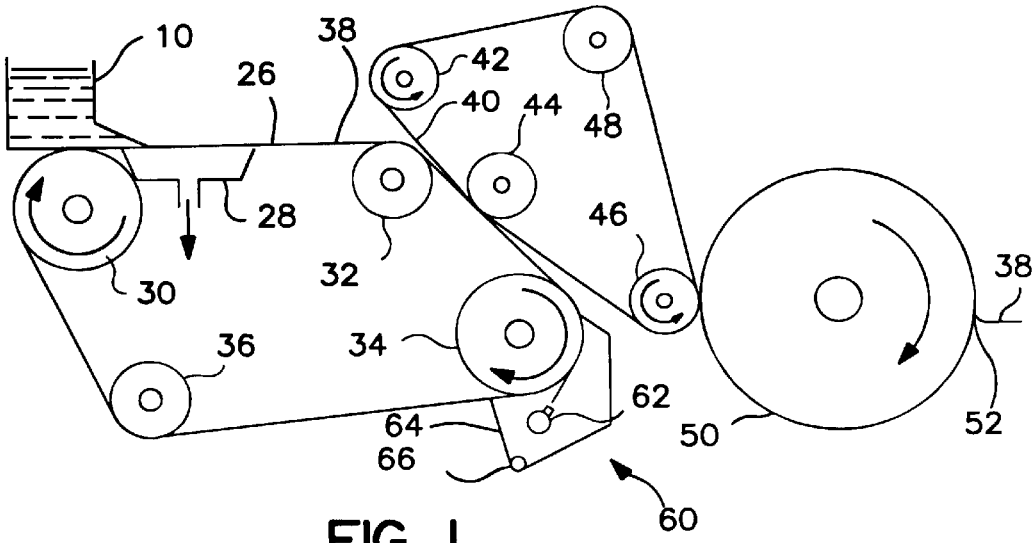
FIG. 1 is a schematic diagram of one embodiment of a wet papermaking machine made in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended to limit the broader aspects of the present invention which broader aspects are embodied in the exemplary construction.

In general, the present invention is directed to a system and process for cleaning a forming fabric in wet papermaking process. In particular, the present invention is directed to cleaning forming fabrics that are adapted to receive a suspension of fibers and that are used to facilitate formation of the nonwoven web while the web contains a substantial amount of moisture. Through the process of the present invention, various debris is removed from the forming fabric, particularly unwanted paper fibers which, when present, can adversely interfere with the papermaking process.

In general, the system of the present invention for cleaning forming fabrics includes a scarfing shower that emits a stream of fluid onto the forming fabric. This stream of fluid tangentially contacts the forming fabric in a direction opposite to which the fabric is moving. Further, the stream of fluid contacts the forming fabric while the forming fabric is moving around a turning roll. Preferably the fabric is wrapped around the turning roll less than 90 degrees, and in one embodiment, less than 120 degrees.

In the past, fluid sprays have been used in order to clean papermaking conveyors. For instance, U.S. Pat. No. 5,783,044, which is incorporated herein by reference, discloses a belt cleaning device for papermaking machines. The device includes at least one nozzle which can be directed against a papermaking transport belt for spraying the woven belt with liquid or gaseous fluid. A suction chamber surrounds and cooperates with the cleaning nozzle so that dirt and/or water mist detached by the nozzle jet from the transport belt or residual water are drawn into the suction chamber and led away. A shower disposed adjacent to the forming wire of a paper machine is also disclosed in U.S. Pat. No. 5,958,190, while U.S. Pat. No. 2,255,951 discloses a fluid nozzle which tangentially contacts a wire cloth for removing foam or air bubbles. Other tangential spray devices are also known for use in conjunction with through air dryers of paper webs. As will be made apparent from the following detailed description, however, various features and aspects of the present invention remain absent from the prior art.

Referring to FIG. 1, one embodiment of a papermaking system made in accordance with the present invention is illustrated. As shown, the papermaking system includes a headbox 10 configured to distribute a dilute aqueous suspension of papermaking fibers. An endless traveling forming fabric 26 receives the fiber suspension from headbox 10. In particular, the fiber suspension is spread over the forming fabric in order to create a nonwoven web. Once retained on fabric 26, the fiber suspension passes water through the fabric. Specifically, water removal is achieved by combinations of gravity, centrifugal force and vacuum suction depending upon the forming configuration. In the embodiment illustrated in FIG. 1, a vacuum 28 is disposed beneath forming fabric 26 and is adapted to remove water from the fiber furnish to a assist in forming a web 38.

As shown, forming fabric 26 is supported and driven by a plurality of turning rolls 30, 32, 34 and 36. From forming fabric 26, nonwoven web 38 is transferred to second fabric 40. Forming fabrics 26 and 40 can be made from any suitable porous material, such as metal wires or polymeric filaments. Forming fabric 40 is supported for movement around a continuous path by a plurality of turning rolls 42, 46 and 48. Also included is a pickup roll 44 designed to facilitate transfer of web 38 from fabric 26 to fabric 40. The speed at which fabric 40 is driven may or may not be at approximately the same speed at which fabric 26 is driven so that movement of web 38 through the system is consistent or is being creped.

From forming fabric 40, web 38, in this embodiment, is transferred to the surface of a rotatable heated dryer drum 50, such as a Yankee dryer. Nonwoven web 38 is lightly presses into engagement with the surface of dryer drum 50 to which it adheres, due to its moisture content and its preference for the smoother of the two surfaces. In some cases, a creping adhesive, such as an ethylene vinyl acetate, can be applied over the web surface or drum surface for facilitating attachment of the web to the drum.

As nonwoven web 38 is carried through a portion of the rotational path of the dryer suface, heat is imparted to the web causing most of the moisture contained within the web to be evaporated. In this embodiment, nonwoven web 38 is removed from dryer drum 50 by creping blade 52. Although optional, creping web 38 as it is formed reduces internal bonding within the web and increases softness and bulk.

In an alternative preferred embodiment, nonwoven web 38 can be throughdried. A throughdryer accomplishes the removal of moisture from the web by passing hot air through the web without applying any mechanical pressure. Throughdrying can further increase the bulk and softness of the web.

The papermaking system illustrated in FIG. 1 is particularly well suited to producing tissues, such as facial tissues. Tissue products typically have a relatively low basis weight and, depending upon the particular application, can contain relatively short fibers. Consequently, in these types of processes, errant fibers have a tendency to accumulate on the forming fabrics, particularly forming fabric 26 during the papermaking process. As described above, these unwanted fibers once accumulated on the forming fabric can adversely affect process stability and sheet formation.

Figure 2:
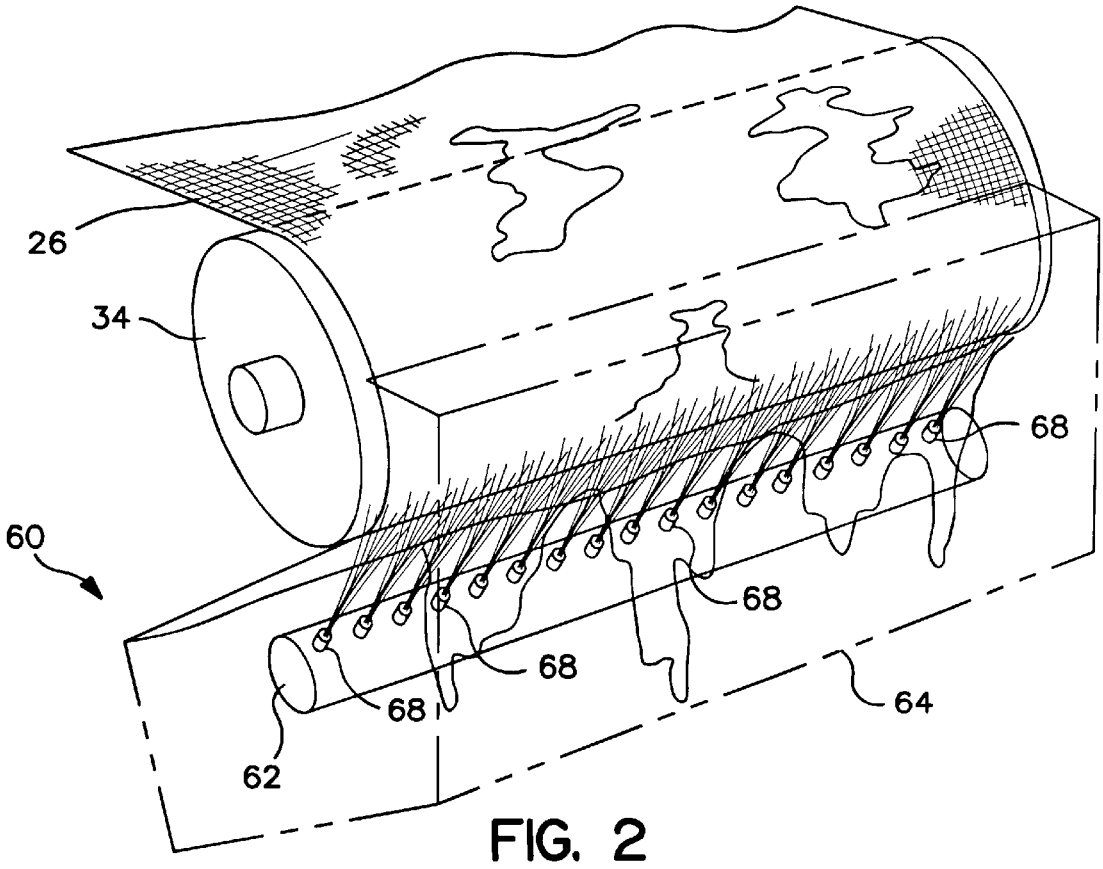
FIG. 2 is a perspective view of one embodiment of a scarfing shower made in accordance with the present invention.
Figure 3:
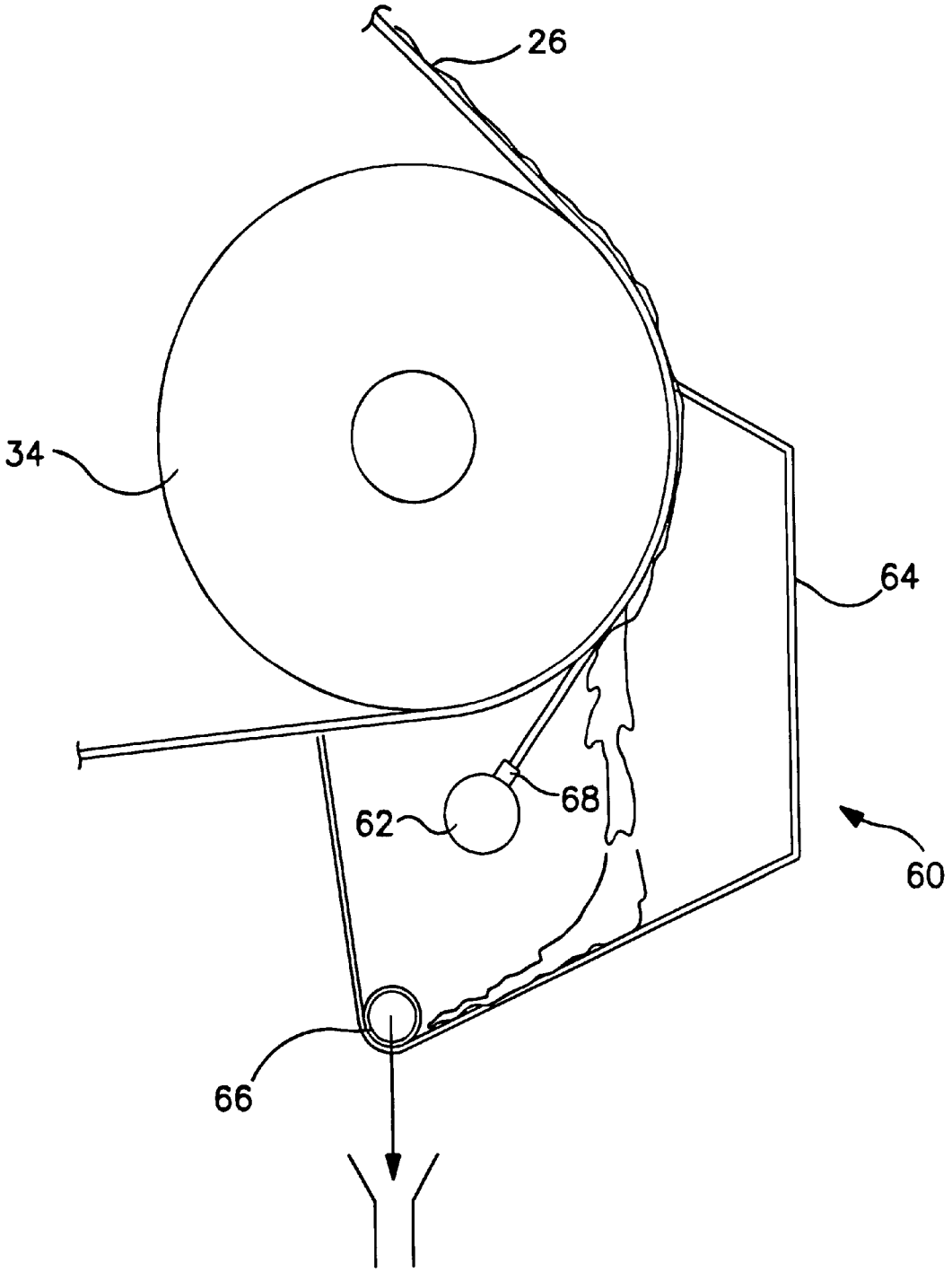
FIG. 3 is a side view of the scarfing shower illustrated in FIG. 2.

In accordance with the present invention, in order to remove unwanted fibers and other debris from forming fabric 26, the papermaking system includes a fabric cleaning system generally 60, which is particularly illustrated in FIGS. 2 and 3.

As shown, fabric cleaning system 60 includes a scarfing shower 62 which, in this embodiment, comprises a plurality of nozzles 68 which extend the entire width of forming fabric 26. Scarfing shower 62 is surrounded by a collecting pan 64 which collects a cleaning fluid being emitted by nozzles 68 after the fluid has impinged upon forming fabric 26. As shown in FIGS. 1 and 3, collecting pan 64 can include a drain line 66 for removing the cleaning fluid.

According to the present invention, scarfing shower 62 is positioned so that the cleaning fluid issuing from nozzles 68 tangentially contacts forming fabric 26. Scarfing shower 62 is also positioned at a point were the forming fabric is wrapped around turning roll 34. More particularly, preferably the scarfing shower is place at a location were the forming fabric is wrapped around the turning roll with a wrap of less than 120 degrees. It has been discovered that the wrapped roll surface facilitates removal of fibers and debris from the forming wire during tangential impingement of the fluid spray on the fabric.

Further, it is also been discovered that the scarfing shower is preferably located such that the cleaning fluid that contacts the forming fabric is flowing in a direction opposite to which the forming fabric is moving. It is believed that this configuration provides the optimal conditions for removing debris from the forming fabric. In particular, it is believed that the centrifugal force generated around the turning roll assists in removing unwanted debris and fibers from the fabric along with the increased momentum that is present at the above described location. Also, the system of the present invention typically requires much less cleaning fluid in comparison to many prior art systems. Unexpectedly, it has also been discovered that the cleaning system of the present invention actually reduces fiber carry back i.e. reduces the amount of fibers that remain on the forming fabric when the formed nonwoven web is removed from the fabric.

As shown in FIG. 2, scarfing shower 62 can comprise a plurality of nozzles which each emit a spray of fluid. In general, the nozzles should be spaced from each other and at a distance from the forming fabric such that the entire width of the forming fabric is contacted by the fluid. For example, in one embodiment, the nozzles can be spaced from about 0.5 inches to about 3 inches apart, and particularly from about 1 inch to about 2 inches apart. Further, the nozzles can be spaced from the fabric such that a shower being emitted from the nozzles travels from about 2 inches to about 6 inches, and particularly from about 3 inches to about 4 inches before contacting the fabric.

The cleaning fluid that is used in the system of the present is preferably a liquid, such as water. In one embodiment, the cleaning fluid can be hot water having a temperature of at least 100 degrees F., and particularly at a temperature of at least 150 degrees F. In one embodiment, the cleaning fluid can include an aqueous solution containing a surfactant, such as a soap.

The pressure at which the cleaning fluid is emitted from nozzles 68 will depend upon the particular application and the position of the scarfing shower. When the cleaning fluid is a liquid, for most applications, the cleaning fluid should be emitted from the nozzles at a pressure of at least 50 psi, particularly at a pressure of at least 100 psi, and more particularly at a pressure of from about 100 psi to about 400 psi.

The present invention may be better understood with reference to the following example.

EXAMPLE

A fabric cleaning system made in accordance with the present invention and similar to the one illustrated in the Figures was installed and used to clean returning fabrics in a process for producing paper webs. The scarfing shower was installed and aligned with a forming fabric such that water issuing from a series of nozzles tangentially contacted the forming fabric in a direction opposite to the direction in which the fabric was moving. The shower nozzles were spaced 1.5 inches apart along the width of the forming fabric at a location were the fabric was being wrapped around a turning roll with a wrap of about 90 degrees. High pressure water was emitted from the nozzles at a pressure of about 200 psi. The nozzle tips were located where the issuing jets are traveling a distance of from about 3 to 4 inches to hit the forming fabric. The scarfing shower was installed on two separate fabrics.

During the trial, fiber removal rates of 90 to 95 percent were observed on the first forming fabric, while fiber removal rates of from about 30 percent to about 40 percent were observed on the second forming fabric. It was also noticed that the scarfing showers provided the unexpected benefit of reducing fiber carry back (about 20 percent reduction).

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for removing unwanted fibers and contact cleaning a forming fabric with a liquid cleaning fluid during a wet papermaking process comprising:

a forming fabric, the fabric having a portion that contains entrapped fibers, a turning roll having a top side and an underside, said forming fabric being wrapped around said turning roll such that an upper portion of said forming fabric contains entrapped unwanted fibers, said upper portion being configured to travel around the turning roll to emerge on the underside of the roll; and a scarfing shower configured to emit an upward-directed stream of liquid cleaning fluid at a pressure of at least about 50 psi, said scarfing shower being positioned to directly strike said forming fabric from below, on the underside of said turning roll, while said forming fabric is moving around said turning roll, thereby dislodging unwanted fibers from said forming fabric, said stream of cleaning fluid flowing in an upward direction and opposite to the direction of said moving forming fabric.

2. A system as defined in claim 1, wherein said forming fabric is wrapped around the turning roll from about 2 degrees to about 90 degrees.

3. A system as defined in claim 1, wherein said forming fabric is wrapped around said turning roll less than 120 degrees.

4. A system as defined in claim 1, wherein said cleaning fluid comprises an aqueous solution having a temperature of at least about 100 degrees F.

5. A system as defined in claim 4, wherein said aqueous solution comprises water and a surfactant.

6. A system as defined in claim 1, wherein said scarfing shower is configured to emit said stream of cleaning fluid at a pressure of at least 100 psi.

7. A system as defined in claim 1, further comprising a collecting pan configured to collect said stream of fluid after said fluid has contacted said forming fabric.

8. A system as defined in claim 1, wherein said scarfing shower is positioned such that said stream of cleaning fluid travels from about 2 inches to about 6 inches before striking said forming fabric.

9. A system as defined in claim 1, wherein said scarfing shower comprises a plurality of nozzles extending along the width of said forming fabric.

10. A system as defined in claim 9, wherein said nozzles are spaced from about 0.5 inches to about 3 inches apart.

11. A process for cleaning unwanted fibers from a forming fabric during a wet papermaking process comprising the steps of:

(a) providing a moving forming fabric, wrapped around and rotatable upon a turning roll, the forming fabric being configured to carry fibrous material;

(b) striking the forming fabric with at least one pressurized stream of cleaning liquid while the fabric is moving around the turning roll, wherein the stream of cleaning liquid is ejected to the forming fabric in a direction which is opposite to the direction in which said forming fabric is moving; and (c) dislodging from the forming fabric undesirable fibrous material.

12. A process as defined in claim 11, wherein said forming fabric is wrapped around said turning roll less than 120 degrees.

13. A process as defined in claim 11, wherein said liquid comprises an aqueous solution.

14. A process as defined in claim 13, wherein said aqueous solution comprises water and a surfactant.

15. A process as defined in claim 11, wherein said stream of cleaning liquid is at a pressure of at least 50 psi.

16. A process as defined in claim 11, wherein said stream of cleaning liquid is at a pressure of at least 100 psi.

17. A process as defined in claim 11, wherein said stream of cleaning liquid is at a pressure of at least 150 psi.

18. A process as defined in claim 11, wherein said stream of cleaning liquid is produced by a plurality of nozzles that are positioned along the width of said forming fabric.

19. A method for pressurized cleaning of unwanted fibrous material from a forming fabric during a wet papermaking process comprising the steps of:

providing a moving forming fabric, said forming fabric being wrapped around a turning roll, said forming fabric having an underside and a top side, the underside having unwanted fibrous material embedded therein, and the top side being configured to receive a suspension of papermaking fibers;

striking said forming fabric with a pressurized stream of cleaning liquid while said fabric is moving around said turning roll, said stream of cleaning liquid striking said forming fabric at a location generally tangent to said fabric, said stream of cleaning liquid flowing in a direction opposite to the direction in which said forming fabric is moving.

20. The method of claim 19 in which the pressurized stream is ejected from a plurality of spaced nozzles.

21. The method of claim 19 in which the pressurized stream is ejected at a pressure of from at least about 100 psi.

22. The method of claim 19 in which the pressurized stream is ejected at a pressure of from about 100 psi to about 400 psi.

23. The method of claim 19 in which the pressurized stream comprises a cleaning liquid which includes a surfactant.

24. The method of claim 19 in which the pressurized stream comprises a cleaning liquid which includes soap.

25. The method of claim 19 in which the pressurized stream is ejected from a point below the fabric, the stream traveling upward to strike the fabric as the fabric moves around the turning roll.

26. The method of claim 19 comprising the additional step of:

collecting in a pan a slurry of unwanted fibrous material for disposal.

27. The method of claim 26, wherein said stream of cleaning liquid is at a pressure of at least 50 psi.

28. The method of claim 26, wherein said stream of cleaning liquid is at a pressure of at least 100 psi.

29. The method of claim 26, wherein said stream of cleaning liquid is at a pressure of at least 100–400 psi.

30. The method of claim 29, wherein said stream of cleaning liquid is produced by a plurality of spaced nozzles positioned along the width of said forming fabric.

31. A system for cleaning with a high pressure liquid spray undesired fibrous material from a forming fabric during a wet papermaking process comprising:

a forming fabric;

a turning roll, said forming fabric being wrapped around said turning roll; and a scarfing shower comprising a plurality of nozzles that are configured to emit a stream of cleaning liquid, the cleaning liquid comprising an aqueous solution of a surfactant or soap, the cleaning liquid being provided along the width of said forming fabric at a pressure of between about 50 and about 400 psi, said scarfing shower being positioned such that said stream of cleaning liquid tangentially contacts said forming fabric while said forming fabric is moving around said turning roll, thereby cleaning said forming fabric by dislodging fibrous matter from said forming fabric.

32. A system as defined in claim 31, wherein said scarfing shower is configured to emit a stream of cleaning liquid in a direction that is opposite to the direction in which said forming fabric moves.

33. A system as defined in claim 32, wherein said forming fabric is wrapped around said turning roll less than 90 degress.

34. A system as defined in claim 31, wherein said plurality of nozzles are spaced such that said stream of cleaning liquid travels from about 2 inches to about 6 inches prior to contacting said forming fabric.

35. A system as defined in claim 31, wherein said plurality of nozzles are spaced from about 0.5 inches to about 3 inches apart along the width of said forming fabric.

* * * * *